US005397902A

United States Patent [19]

Castner et al.

[11] Patent Number: 5,397,902

[45] Date of Patent: Mar. 14, 1995

[54] APPARATUS AND METHOD FOR THE PREPARATION OF A RADIOPHARMACEUTICAL FORMULATION

[75] Inventors: James F. Castner, Groton, Mass.; Bobby E. Corry, Merrimack; Thomas D. Harris, Salem, both of N.H.; Richard J. Looby, Woburn, Mass.

[73] Assignee: The Du Pont Merck Pharmaceutical Company, Wilmington, Del.

[21] Appl. No.: 167,685

[22] Filed: Dec. 15, 1993

[51] Int. Cl.[6] ..... G21F 5/00

[52] U.S. Cl. ..... 250/432 PD; 250/506.1

[58] Field of Search ..... 250/432 PD, 506.1, 507.1; 423/2; 128/659; 252/645; 600/3

[56] References Cited

U.S. PATENT DOCUMENTS

| | | | |
|---|---|---|---|
| 3,531,644 | 9/1970 | Koster | 250/106 |
| 3,655,985 | 4/1972 | Brown et al. | 250/106 R |
| 3,673,411 | 6/1972 | Glasser | 250/106 R |
| 3,727,059 | 0/1973 | Reese | 250/506.1 |
| 3,811,591 | 5/1974 | Novitch | 215/12 R |
| 3,882,315 | 5/1975 | Soldan | 250/506 |
| 3,912,935 | 10/1975 | Harris | 250/506 |
| 3,971,955 | 7/1976 | Heyer et al. | 250/507 |
| 4,020,355 | 4/1977 | Czaplinski | 250/506 |
| 4,074,824 | 2/1978 | Kontes | 215/365 |
| 4,081,688 | 3/1978 | Fries | 250/506 |
| 4,084,097 | 4/1978 | Czaplinski | 250/506 |
| 4,382,512 | 5/1983 | Furminger | 206/446 |
| 4,435,358 | 3/1984 | Kreiger | 376/272 |
| 4,673,813 | 6/1987 | Sanchez | 250/506.1 |
| 4,788,438 | 11/1988 | Evers | 250/506.1 |
| 4,806,098 | 2/1989 | Ramm et al. | 432/215 |
| 4,894,550 | 1/1990 | Baatz et al. | 250/506.1 |
| 5,039,863 | 8/1991 | Matsuno et al. | 250/432 PD |
| 5,109,160 | 4/1992 | Evers | 250/432 |

FOREIGN PATENT DOCUMENTS

| | | |
|---|---|---|
| 211528A | of 1971 | European Pat. Off. . |
| 2540663 | of 1983 | France . |
| 322764A | of 1982 | Germany . |
| 2186300 | of 1989 | Japan . |
| 23873 | of 1973 | United Kingdom . |

OTHER PUBLICATIONS

Journal of Nuclear Medicine Technology, Wilson et al., Letters to the Editor, p. 180.

Hung et al., Rapid Preparation and Quality Control Method for Technetium-99m-2-Methoxy Isobutyl Isonitrile (Technetium-99n-Sestamibi), J. of Nuclear Medicine, vol. 32, No. 11, Nov. 1991, pp. 2162-2168.

(List continued on next page.)

*Primary Examiner*—Jack I. Berman

*Attorney, Agent, or Firm*—Gerald J. Boudreaux

[57] ABSTRACT

Apparatus and method for producing a radiopharmaceutical formulation utilize a radiation-shielding container for receiving a vial having the non-radioactive components necessary to form a radiopharmaceutical formulation therein. A mixture of such non-radioactive components and a radioactive liquid added thereto is both heated and cooled using a thermoelectric element. The container comprises a hollow outer shielding member formed from a radiation shielding material and a vial holder formed from a highly heat conductive material received therewithin. The vial holder includes a skirt portion that defines a socket. The socket is sized to receive in an intimate heat transmissive relationship a mounting projection that is itself connected in thermally conductive contact with the thermoelectric element. Using the thermoelectric heating and cooling element, heat is both applied to and removed from the radioactive liquid and the non-radioactive components within the vial while the vial is held within the vial holder within the radiation shielding container, thereby to produce a radiopharmaceutical formulation within the vial.

5 Claims, 2 Drawing Sheets

OTHER PUBLICATIONS

Hung et al., Breakage of Technetium-99m-Sestamibi Vial with the use of a Microwave Oven, The Journal of Nuclear Medicine, vol. 33, No. 1, Jan. 1992, pp. 176-178.

Wilson et al., An Alternative Method for Rapid Preparation of 99 Tcm—sestamibi, Nuclear Medicine Communications (1993) 14, 544-549.

Taillefer et al., Labeling Procedure and in-vitro Stability of Tc-99m Methoxy Isobutyl Isonitrile (MIBI): Practical Considerations, Proceedings of the 36th Annual Meeting, J. Nucl. Med., vol. 30, No. 5, May 1989, p. 865.

Gagnon et al., Fast Labeling of Technetium-99m-Sestamibi with Microwave Oven Heating, J. of Nuclear Medicine Technology, 1991, vol. 19, pp. 90-93.

Operations Manual, Version 1.2, The MiniCycler, MJ Research, Inc., Watertown Mass. 02172.

FIG.2B
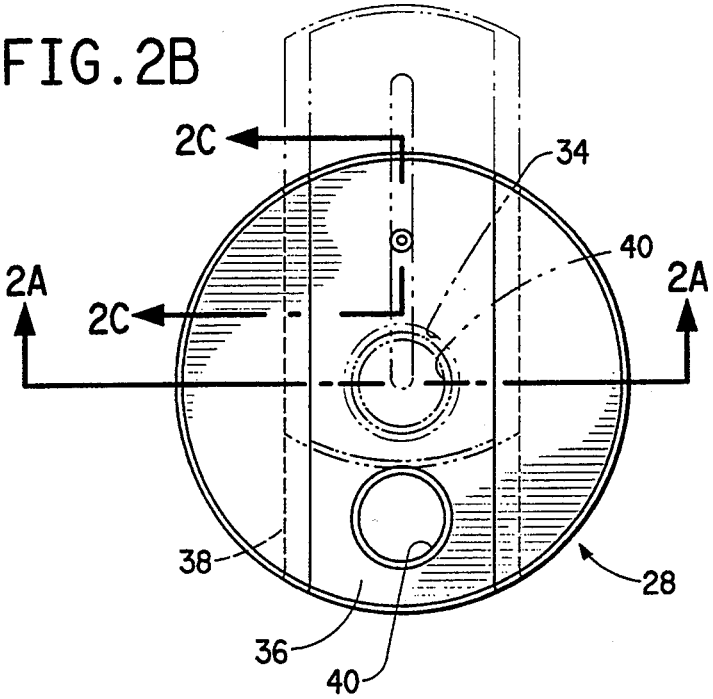
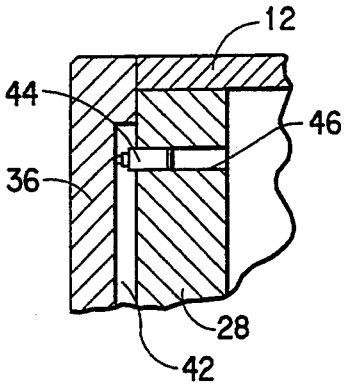
FIG.2C
FIG.2A
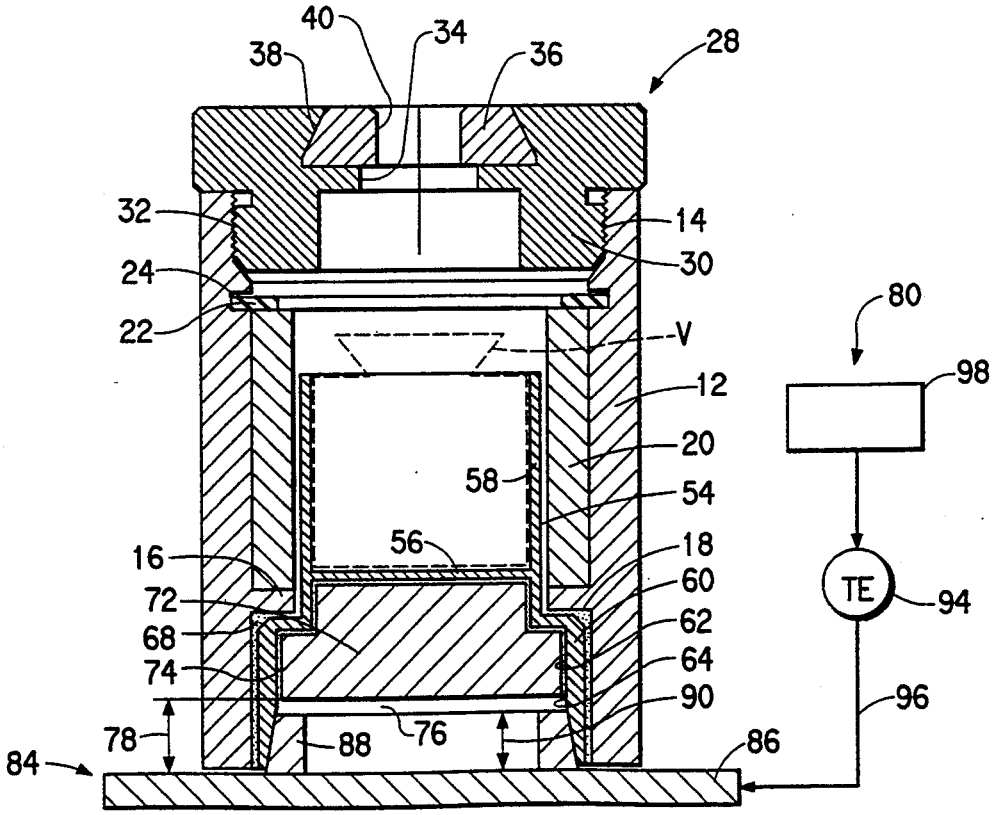

APPARATUS AND METHOD FOR THE PREPARATION OF A RADIOPHARMACEUTICAL FORMULATION

BACKGROUND OF THE INVENTION

1. Field of the Invention

The present invention relates to apparatus and a method for the rapid preparation of a radiopharmaceutical formulation.

2. Description of the Prior Art

Technetium $Tc^{99}m$-Sestamibi is a technetium-labeled radiopharmaceutical that is manufactured by DuPont-Merck Pharmaceutical Company, Billerica, Mass., and sold under the trademark Cardiolite®. Technetium $Tc^{99}m$-Sestamibi finds primary utility as a myocardial imaging agent.

A formulation of the technetium-labeled radiopharmaceutical imaging agent is prepared for use by injecting a volume (on the order of approximately one to three milliliters) of a non-pyrogenic sodium pertechnetate $Tc^{99}m$ solution derived from a generator into a vial containing a lyophilized form of other non-radioactive ingredients [particularly, appropriate amounts of (2-methoxy isobutyl isonitrile) copper tetrafluoroborate, sodium citrate dihydrate, cysteine hydrochloride monohydrate, mannitol and stannous chloride dihydrate]. The vial is itself placed in a suitable radiation shield, typically a cylindrical can-like member with a fitted cap. Label instructions require that after injection the vial containing the mixture of the sodium pertechnetate and the lyophilized non-radioactive ingredients be removed from the radiation shield, and heated in a boiling water bath for at least ten minutes. After heating in the boiling bath the vial is returned to the shield for a cool-down period of approximately fifteen minutes. A radiochemical purity analysis is performed to insure that the radiopharmaceutical formulation so prepared exhibits the desired labeling efficiency prior to use.

These timing restrictions on the preparation of Technetium $Tc^{99}m$-Sestamibi radiopharmaceutical formulation may, in instances such as emergency cases, limit its availability. In order to reduce the preparation time and, consequently, enhance the availability of Technetium $Tc^{99}m$-Sestamibi imaging formulation, several alternative methods of its preparation have been proposed.

One method, discussed in the article by Tallifer, Gagnon, Lambert and Levilie, "Labeling procedure and in-vitro stability of Tc99m methoxy isobutyl isonitrile (MIBI): practical considerations", appearing at *J Nucl Med* 1989; 30; 865 (abs), demonstrates that bath times as low as one (1) minute may be sufficient to provide a Technetium $Tc^{99}m$-Sestamibi solution having an acceptable labeling efficiency and a radiochemical purity in excess of ninety percent. However, this method still requires a significant amount of time (on the order of ten to twenty-five minutes) be expended to heat to boil the water used for the immersion bath. Thus, the time gain obtained from the reduction in the actual immersion time is lost because time is still required to heat the water for the immersion bath.

Other proposed methods of preparation of Technetium $Tc^{99}m$-Sestamibi formulation have focused on the use of alternative heat sources. Several alternative methods discuss the use of a microwave oven as the source of heat. Microwave heating methods are discussed in an article by Gagnon, Tallifer, Bavaria and Levilie, "Fast labeling of technetium-99m-sestamibi with microwave oven heating", *J Nucl Med Technol* 1991; 19; 90–3, and in an article by Hung, Wilson, Brown and Gibbons, "Rapid preparation and quality control method for technetium-99m-2 methoxy isobutyl isonitrile (technetium-99m sestamibi)", *J Nucl Med* 1991; 32; 2162–8. Another method, discussed in a letter by Wilson, Hung and Gibbons, "Simple procedure for microwaved technetium-99m sestamibi temperature reduction", *J Nucl Med Technol* 1992; 20; 180, focuses on a technique for the rapid cooling of the heated Technetium $Tc^{99}m$-Sestamibi formulation.

Although microwave oven-based heating methods appear to overcome some of the obstacles presented in the preparation of Technetium $Tc^{99}m$-Sestamibi formulation, such methods appear also to exhibit serious attendant drawbacks, such as vial breakage (as outlined in a letter by Hung and Gibbons, "Breakage of technetium-99m sestamibi vial with the use of a microwave oven", *J Nucl Med* 1992; 33; 176–8). Other perceived problems with the microwave oven-based heating technique are set forth in an article by Wilson, Hung and Gibbons, "An alternative method for rapid preparation of $^{99}Tc^{m}$-sestamibi", *Nucl Med Commun* 1993; 14; 544–9. This latter article proposes an alternative heating method involving the use of an instant hot water machine as the source of heated water used for the preparation of Technetium $Tc^{99}m$-Sestamibi formulation.

Other heating sources for raising the temperature of materials used in connection with life science reactions are known in the art. For example, an apparatus manufactured by MJ Research, Inc, Watertown, Mass. and sold as "The MiniCycler TM programmable thermal controller" utilizes a heating/cooling element driven by the thermoelectric effect to both heat and cool samples for various biotechnological reactions. The basic operating principle of a thermoelectric heating/cooling element is the Peltier Cooling Effect, in which heat is absorbed or generated as a current passes through a junction of two dissimilar materials. Electrons passing across the junction absorb or give up an amount of energy equal to the transport energy and the energy difference between the dissimilar-materials conduction bands.

The materials to be heated or cooled in the programmable thermal controller apparatus are typically carried in microultracentrifuge tubes, also known as "Eppendorf Tubes", or in other suitable reaction tubes. The programmable thermal controller includes a sample block in which a plurality of wells are formed. Each tube carrying a sample therein is inserted into a well, and the appropriate heating and/or cooling program initiated. Each of the wells formed in the sample block corresponds in configuration to the exterior configuration of the container inserted therein. Use of the programmable thermal controller in connection with radioactive reactions appears to be contemplated.

In view of the foregoing it is believed advantageous to utilize a thermoelectric (Peltier-effect) heating/cooling element to precisely control both heating and cooling of Technetium $Tc^{99}m$-Sestamibi imaging formulation, thereby to make preparation of an effective dosage of the imaging formulation rapidly available for use in emergency and other situations.

SUMMARY OF THE INVENTION

The present invention is directed to both apparatus and a method for using a thermoelectric heating/cooling element both to apply heat to and/or remove heat from a vial having the components necessary to form a radiopharmaceutical formulation contained therein.

In a first aspect the invention is directed toward a radiation-shielding container for receiving a vial having the components necessary to form a radiopharmaceutical formulation therein and in which such components may be both heated and cooled. The container comprises a hollow outer shielding member formed from a radiation shielding material, such as lead or tungsten, and a vial holder received within the outer shielding member. The outer shielding member substantially completely surrounds the vial holder. The vial holder is fabricated from a material having a high heat conductivity, such as aluminum or copper. The vial holder includes a skirt portion that defines a socket. The socket defined by the skirt is sized to receive a mounting projection in a heat transmissive relationship. A shielding plug, also formed of a radiation shielding material, may be disposed within the socket defined by the skirt portion of the vial holder.

In another aspect the invention is directed to an apparatus in which the components necessary to form a radiopharmaceutical formulation contained within the vial are both heated and cooled. The apparatus comprises the container as set forth above, a thermoelectric heating and cooling element, and a mounting block connected in thermal conductive contact with the thermoelectric heating and cooling element. The mounting block has a mounting projection thereon that is sized for receipt in a heat transmissive relationship within the socket defined by the skirt portion of the vial holder of the container.

In yet another aspect the present invention is directed to a method for preparing rapidly a radiopharmaceutical formulation within a vial. The method comprises the steps of inserting into a vial holder a vial having therein the non-radioactive components necessary to form a radiopharmaceutical formulation. In some instances the non-radioactive components may be in lyophilized form. The vial holder is disposed within and substantially surrounded by a radiation-shielding container. The vial holder is fabricated from a material having a high thermal conductivity and includes a skirt portion that defines a socket. A radioactive liquid is added to the non-radioactive components in the vial, preferably after the vial is inserted into the radiation-shielding container. The vial holder is disposed in a heat transmissive relationship with a mounting projection on a mounting block by mounting the skirt portion onto the projection such that the projection extends into and is in thermal contact with the skirt portion of the vial holder. The mounting block is itself in thermal conductive contact with a thermoelectric heating and cooling element. Using the thermoelectric heating and cooling element, heat is both applied to and removed from the mixture of the radioactive liquid and the (lyophilized) non-radioactive components within the vial while the vial is held within the vial holder within the radiation shielding container, thereby to produce a radiopharmaceutical formulation within the vial.

BRIEF DESCRIPTION OF THE DRAWINGS

The invention will be more fully understood from the following detailed description, taken in accordance with the accompanying drawings, which form a part of this application and in which:

FIG. 2A is a stylized diagrammatic representation of an apparatus for both heating and cooling the components necessary to form a radiopharmaceutical formulation using a thermoelectric heating and cooling element, the apparatus including the container of FIG. 1, which is shown in FIG. 2A in a side elevational view, entirely in section, in its fully assembled condition;

FIG. 2B is a plan view of the container shown in FIG. 2A; and

FIG. 2C is an orthographic view of the cap of the container of FIGS. 2A and 2B taken along section lines 2C—2C in FIG. 2B.

DETAILED DESCRIPTION OF THE INVENTION

Figure 1:
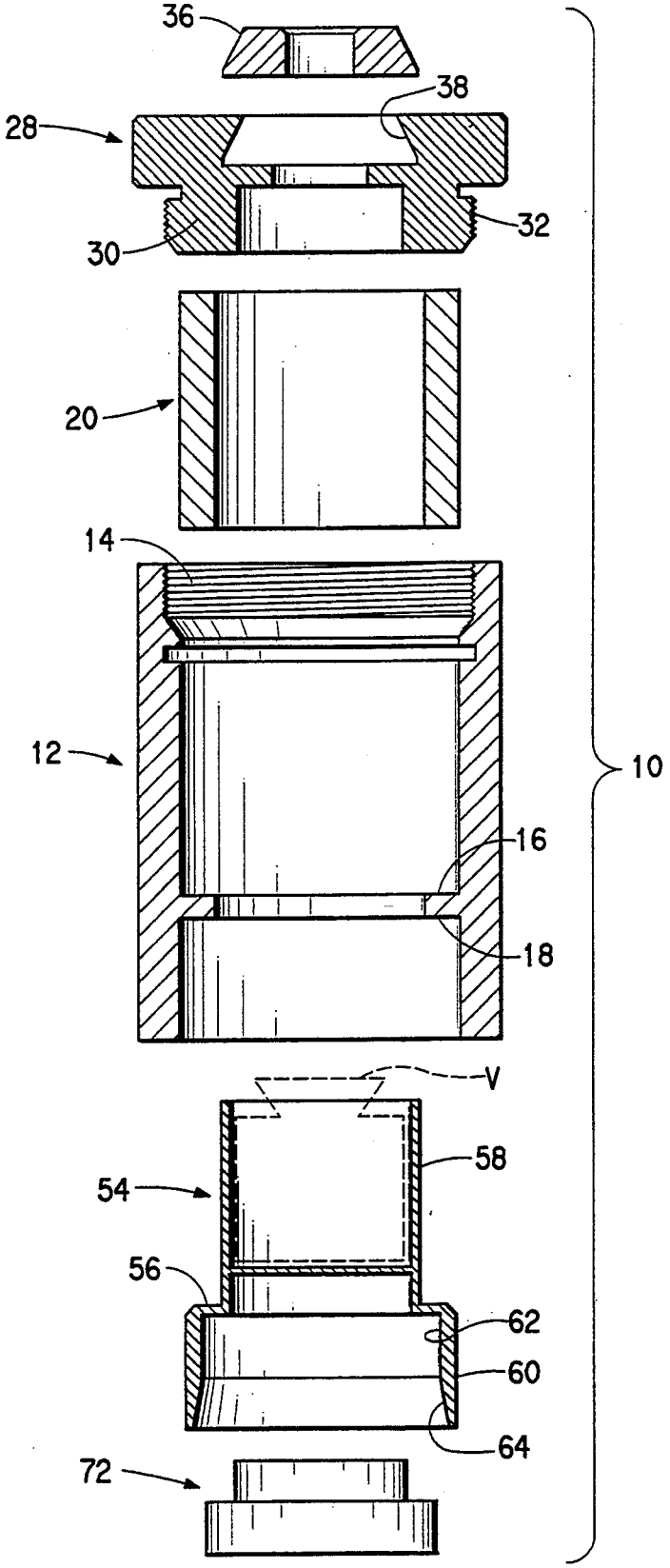
FIG. 1 is an exploded side elevational view, entirely in section, of a container for preparing a radiopharmaceutical formulation in accordance with a first aspect of the present invention.

Throughout the following detailed description similar reference numerals refer to similar elements in all Figures of the drawings.

FIG. 1 shows an exploded sectional view of a radiation-shielding container generally indicated by the reference character 10 in accordance with a first aspect of the present invention. As will be developed the radiation-shielding container 10 receives a vial V having contained therein various non-radioactive components necessary to form a radiopharmaceutical formulation. In some instances the non-radioactive components may be in lyophilized form. A radiopharmaceutical formulation is produced by heating and thereafter cooling a mixture of the (lyophilized) non-radioactive components and a radioactive liquid. The radiation-shielding container 10 supports the vial V while the mixture of the non-radioactive components and the radioactive liquid is being heated and cooled. The application of heat to and the removal of heat from the mixture is effected utilizing the apparatus diagrammatically indicated by the reference character 80 of FIG. 2. The vial V may carry the components necessary to produce any of a variety of radiopharmaceutical formulations, as, for example, the technetium-labeled radiopharmaceutical Technetium $Tc^{99}$m-Sestamibi myocardial imaging agent manufactured by DuPont-Merck Pharmaceutical Company, Billerica, Mass., and sold under the trademark Cardiolite®. The radiopharmaceutical formulation also manufactured by DuPont-Merck Pharmaceutical Company and sold under the trademark Neurolite® may also be produced using the various aspects of the present invention.

The container 10 includes an outer shielding member 12, perhaps best seen in FIG. 2A. The outer shielding member 12 is a hollow, tubular member formed from a radiation shielding material, such as lead or tungsten. For reasons of structural rigidity and machinability, tungsten is preferred. However, in instances where a highly radioactive liquid is being used in the preparation of the formulation the shielding member 12 for the container 10 may be fabricated from a material such as depleted uranium.

The shielding member 12 has internal threads 14 formed about the inner surface thereof adjacent to a first axial end. The inner surface of the tubular outer shielding member 12 has, generally adjacent to its opposite axial end, a cutout shelf 16 formed therein, Owing to the presence of the shelf 16 a reduced radial thickness dimension is imparted to the shielding member 12 over the major portion of its axial length. The shelf 16 is undercut to define a shoulder 18 thereon. To increase the radiation shielding capability of the container 10 an inner shielding member 20 is concentrically received within the shielding member 12. The inner shielding member 20, which is preferably fabricated from lead, is closely received within the outer shielding member 12. The inner shielding member 12 seats on the upper surface of the shelf 16, where it is held in place by a snap ring 22. The snap ring 22 is received in a groove 24 formed in the inner surface of the member 12, generally adjacent to the threads 14 provided thereon.

The open first axial end of the outer shielding member 12 is closed by a cap 28. The cap 28 is a generally disc-like member having an annular rim 30 depending from the lower surface thereof. The exterior surface of the rim 30 is threaded, as at 32, whereby the cap 28 may be secured to the threads 14 on the outer shielding member 12. A opening 34 extends central and axially through the cap 28. Access to the opening 34, and thus to the interior of the shielding member 12, is selectably afforded by a closable plug 36. The plug 36 slides in a dovetailed channel 38 formed in the cap 28. The plug 36 has an access port 40 formed therein.

The undersurface of the plug 36 is provided with a groove 42. The groove 42 accepts a spring loaded detent 44 that is received in a bore 46 provided in the disc portion of the cap 28. The detent 44 limits the sliding motion of the plug 36 within the channel 38, and thus maintains the plug 36 on the cap 28. The plug 36 is preferably fabricated from tungsten.

When in the closed position (as shown in solid lines in FIG. 2B, the opening 40 in the plug 36 is laterally offset from the opening 34 in the cap 28. However, the plug 36 may slide within the channel 38 to a position (shown in the dot-dash lines in FIG. 2B) in which the opening 40 in the plug 36 registers with the opening 34 in the cap 28. In this position, a portion of the plug 36 overhangs the cap 28, as illustrated in FIG. 2B.

A vial holder 54 is received within and substantially surrounded by the outer shielding member 12. The vial holder 54 is integrally fabricated, as by machining or stamping, from a material having a high heat conductivity, such as aluminum or copper. Structurally, the vial holder 54 includes a base portion 56 from which a cup-like receptacle 58 upwardly extends. The receptacle 58 is sized to receive closely the vial V. Preferably, the interior surface of the receptacle 58 is electroplated with nickel to protect against corrosion in the event of vial leakage. A skid portion 60 depends from the lower surface of the base 56. The upper portion 62 of the inner surface of the skid 60 is generally cylindrical in shape. However, the lower extent 64 of the inner surface of the skid 60 is flared outwardly and is frustoconical in shape, for a reason to be fully explained herein. The vial holder 54 is secured to the outer shielding member 12 in the vicinity of the internal shoulder 18 by a layer 68 of adhesive material. Any adhesive that is thermally stable to temperatures on the order of approximately 120° C., such as an epoxy material, is suitable for use as the adhesive.

To insure that a vial V received within and carried by the receptacle portion 58 of the vial holder 54 is substantially totally surrounded by a radiation shielding material, a plug 72 is secured into the upper cylindrical portion 62 of the inner surface of the skid 60. The plug 72 is also formed of tungsten, although another suitable radiation shielding material may alternatively be used. The attachment of the plug 72 to the skid 60 is effected by a layer 74 of adhesive. The same epoxy material that forms the adhesive layer 68 is preferred for the adhesive layer 74.

With the plug 72 in place the internal volume bounded by the outer surface of the plug 72 and by the frustoconical portion 64 of the inner surface of the skid 60 defines a socket 76 for a purpose to be described. The socket 76 has a predetermined axial dimension 78.

The radiation-shielding container 10 shown in FIG. 1 comprises an element of an apparatus which serves both to apply heat to and to remove heat from a vial V in which a radiopharmaceutical formulation is produced. The heating and cooling apparatus, which forms a second aspect of this invention, is generally indicated in FIG. 2A by the reference character 80. In addition to the container 10 the heating and cooling apparatus 80 also includes a mounting block 84 and a thermoelectric heating and cooling element 94 that is connected in thermally conductive contact with the mounting block 84.

The mounting block 84 is a generally planar member having a base portion 86. A mounting projection 88 extends upwardly from base portion 86 for a predetermined distance 90. The distance 90 is slightly less than or substantially equal to the axial dimension 78 of the socket 76 defined by the skid portion 60 of the vial holder 54. The socket 76 and the mounting projection 88 are each complementarily sized and shaped to insure that the socket 76 intimately receives the projection 88 in an heat transmissive relationship. To enhance the intimate nesting of the vial holder 54 onto the projection 88, the exterior surface of the projection is tapered to conform to the configuration of the lower extent 64 of the skid portion 60 of the vial holder 54. The flared configuration of the lower extent 64 of the skid 60 facilitates mounting and dismounting of the skid portion 60 to and from the projection 88. The mounting block 84 is preferably fabricated, as by machining, from a highly heat conductive material, such as aluminum.

The thermoelectric heating and cooling element 94 is connected in thermally conductive contact to the mounting block 84, as diagrammatically represented by the connection line 96. The element 94 is fabricated from a suitable heat conductive material, such as aluminum. The thermoelectric element 94 applies heat to end removes heat from the mounting block 84, and the vial holder 54 mounted thereon, under the control of a microcomputer-based controller 98. In practice, the controller 98 serves to adjust the potential difference across the junction of the dissimilar materials forming the element 94. Physically, the thermoelectric heating and cooling element 94 and the mounting block 84 may be integrated into a single unit in the manner exhibited by commercially available thermoelectric heating and cooling apparatus, such as the above-mentioned apparatus manufactured by MJ Research, Inc, Watertown, Mass. and sold as "The MiniCycler TM programmable thermal controller".

Having described the structure of both the container 10 (FIGS. 1 and 2A, 2B, 2C) and the heating and cooling apparatus 80 (FIG. 2A), a method in accordance with yet another aspect of the present invention whereby a radiopharmaceutical formulation is produced within the vial V may now be set forth.

The method includes the step of inserting into a vial holder a vial V having therein the non-radioactive components necessary to form a radiopharmaceutical formulation into the vial holder 54. As noted, these non-radioactive components may, in some instances, be lyophilized. The vial and the vial holder 54 are themselves disposed within and substantially surrounded by the radiation-shielding container 10.

Preferably, with the vial within the vial holder, a radioactive liquid is next added to the components in the vial V. This step is effected by withdrawing a predetermined volume of the radioactive liquid from a radionuclide generator using a shielded syringe. A suitable radionuclide generator is disclosed in U.S. Pat. No. 5,109,160 (Evers), issued Apr. 28, 1992 and assigned to the assignee of the present invention. With the plug 36 in the cap 28 slid within the channel 38 to expose the opening 34 in the cap, the syringe is inserted into the interior of the shield 12 and radioactive liquid injected through the septum of the vial V. The addition of the radioactive liquid serves to reconstitute the non-radioactive components in the event they were stored in the vial in lyophilized form. Although not preferred, it should be noted that it lies within the contemplation of the present invention to inject the radioactive liquid injected into the vial V prior to the insertion of the vial V into the vial holder 54.

Next, the vial holder 54 is disposed in intimate nested contact with a mounting projection 88 on the mounting block 84 by mounting the skirt portion 60 of the vial holder 54 onto the projection 88 such that the projection 88 extends into and is received in thermally conductive contact with the skirt portion 60 of the vial holder 54.

Using the thermoelectric heating and cooling element 94, heat is selectively applied to or removed from the mixture of the radioactive liquid and the non-radioactive components within the vial while the vial is held within the vial holder 54 within the radiation shielding container 10. The radiopharmaceutical formulation is thus produced within the vial. Any appropriate time-temperature profile whereby the heating and cooling of the mixture of the radioactive liquid and the non-radioactive components within the vial may be used, consistent with the particular radiopharmaceutical formulation being produced.

In accordance with the various aspects of the present invention, owing to the controllability and inherent accuracy of a thermoelectric heating and cooling element, a radiopharmaceutical formulation of acceptable labeling efficiency and radiochemical purity may be rapidly produced. In addition, it should be noted that the use of a radiation shielding container 10 in accordance with the present invention permits the production of the radio- pharmaceutical formulation with the radiation exposure to an operator that is as low as reasonably achievable ("ALARA").

EXAMPLE

The use and practice of the various aspects of the present invention may be more fully understood from the following example of the preparation of a technetium-labeled radiopharmaceutical formulation manufactured by DuPont-Merck Pharmaceutical Company, Billerica, Mass., and sold under the trademark Cardiolite ®.

A vial containing a lyophilized form of non-radioactive active ingredients [particularly, appropriate amounts of (2-methoxy isobutyl isonitrile) copper tetrafluoroborate, sodium citrate dihydrate, cysteine hydrochloride monohydrate, mannitol and stannous chloride dihydrate] is itself placed in a vial holder 54 within the outer radiation shielding member 12. With a sterile shielded syringe, a one to three ml volume of additive-free, sterile, non-pyrogenic sodium pertechnetate $Tc^{99}m$ [925–5550Mbq, (15–150mC )] is obtained from a nuclide generator. The sodium pertechnetate $Tc^{99}m$ liquid is aseptically added to the vial. Without withdrawing the needle, an equal volume of headspace is removed from the vial to maintain atmospheric pressure therewithin. The contents of the vial are swirled for a few seconds.

The vial holder 54 within the outer shield 10 is mounted on the mounting projection 88 of the mounting block 84. The skirt portion 60 of the vial holder 54 receives the projection 88 such that the projection 88 extends into and is received in thermally conductive contact with the skirt portion 60 of the vial holder 54. Under program control the contents of the vial are heated and cooled using the thermoelectric element in accordance with the following time temperature profile:

1) In one minute, the temperature of the block 64 is increased from ambient temperature (approximately 20° C.) to 119° C.;
2) The block is held at 119° C. for four minutes;
3) In two to three minutes, the temperature of the block 64 is decreased from 119° C. to 10° C.); and
4) The block is held at 10° C. for one minute.

Using the apparatus and method of the present invention, a radiopharmaceutical formulation exhibiting desired purity and desired labeling efficiency is thus prepared. The overall preparation time is on the order of ten minutes, in contrast with a preparation time on the order of twenty-five minutes required using the boiling water bath technique of the prior art.

Those skilled in the art, having the benefit of the teachings of the present invention as hereinabove set forth may effect numerous modifications thereto. Such modifications are to be construed as lying within the scope of the present invention, as defined by the appended claims.

What is claimed is:

1. A radiation-shielding container for receiving a vial having the components necessary to form a radiopharmaceutical formulation contained therein and in which those components may be both heated and cooled, the container comprising:

a hollow outer shielding member formed from a radiation shielding material; and a vial holder received within and substantially surrounded by the hollow outer shielding member, the vial holder being fabricated from a material having a high heat conductivity, the vial holder including a skirt portion that defines a socket, the socket being sized to receive a mounting projection in a heat transmissive relationship.

2. The radiation-shielding container of claim 1 further comprising a plug formed of a radiation shielding material disposed within the skirt portion.

3. An apparatus in which the components necessary to form a radiopharmaceutical formulation contained within a vial are both heated and cooled, the apparatus comprising:

a thermoelectric heating and cooling element;

a mounting block having a mounting projection thereon, the block being connected in thermal conductive contact with the thermoelectric heating and cooling element, a radiation-shielding container for receiving a vial having the components of a radiopharmaceutical formulation contained therein, the container itself comprising:

a hollow outer shielding member formed from a radiation shielding material, a vial holder received within and substantially surrounded by the hollow outer shielding member, the vial holder being fabricated from a material having a high heat conductivity, the vial holder including a skirt portion that defines a socket, the socket being sized to receive a mounting projection in a heat transmissive relationship.

4. The apparatus of claim 3 further comprising a plug formed of a radiation shielding material disposed within the skirt portion.

5. A method for preparing a radiopharmaceutical formulation within a vial, the method comprising the steps of:

a) inserting into a vial holder a vial having non-radioactive components necessary to form a radiopharmaceutical formulation, the vial holder being itself disposed within and substantially surrounded by a radiation-shielding container, the vial holder being fabricated from a material having a high thermal conductivity and including a skirt portion that defines a socket;

b) adding a radioactive liquid to the non-radioactive components in the vial;

c) disposing the vial holder in a heat transmissive relationship with a mounting projection on a mounting block by mounting the skirt portion of the vial holder onto the projection such that the projection extends into and is in heat transmissive relationship with the skirt portion of the vial holder, the mounting block being itself in thermal conductive contact with a thermoelectric heating and cooling element; and d) using the thermoelectric heating and cooling element, both applying heat to and removing heat from the mixture of the radioactive liquid and the non-radioactive components within the vial while the vial is held within the vial holder within the radiation shielding container, thereby to produce a radiopharmaceutical formulation within the vial.

* * * * *